United States Patent [19]

Sticha

[11] 3,936,207

[45] Feb. 3, 1976

[54] HIGHWAY COLOR CODE MARKING

[76] Inventor: James A. Sticha, Madison, Wis.

[22] Filed: June 28, 1974

[21] Appl. No.: 483,965

Related U.S. Application Data

[63] Continuation of Ser. No. 420,911, Dec. 3, 1973, abandoned.

[52] U.S. Cl. ..... 404/14; 404/1

[51] Int. Cl.[2] ..... E01F 11/00

[58] Field of Search ..... 404/12, 13, 14, 6, 9.1, 404/17, 72, 71

[56] References Cited

UNITED STATES PATENTS

| | | | |
|---|---|---|---|
| 2,136,709 | 11/1938 | Robertson | 404/13 |
| 3,215,051 | 11/1965 | Gill | 404/14 |
| 3,355,999 | 12/1967 | Rusling | 404/12 |
| 3,575,092 | 4/1971 | Freeman | 404/14 X |

FOREIGN PATENTS OR APPLICATIONS

| | | | |
|---|---|---|---|
| 656,175 | 1/1963 | Canada | 404/72 |

*Primary Examiner*—Nile C. Byers, Jr.
*Attorney, Agent, or Firm*—John M. Diehl

[57] ABSTRACT

The course to be followed by a motorist having a preselected destination is indicated by a plurality of markers set in the center of the path to be followed by the motorist, each set of markers having a different color to correspond to a different preselected destination.

6 Claims, 68 Drawing Figures

PART 1

PART 2

INVENTOR.
JAMES A. STICHA

BY

ATTORNEY

PART 3

INVENTOR.
JAMES A. STICHA

BY

ATTORNEY

INVENTOR.
JAMES A. STICHA

BY

ATTORNEY

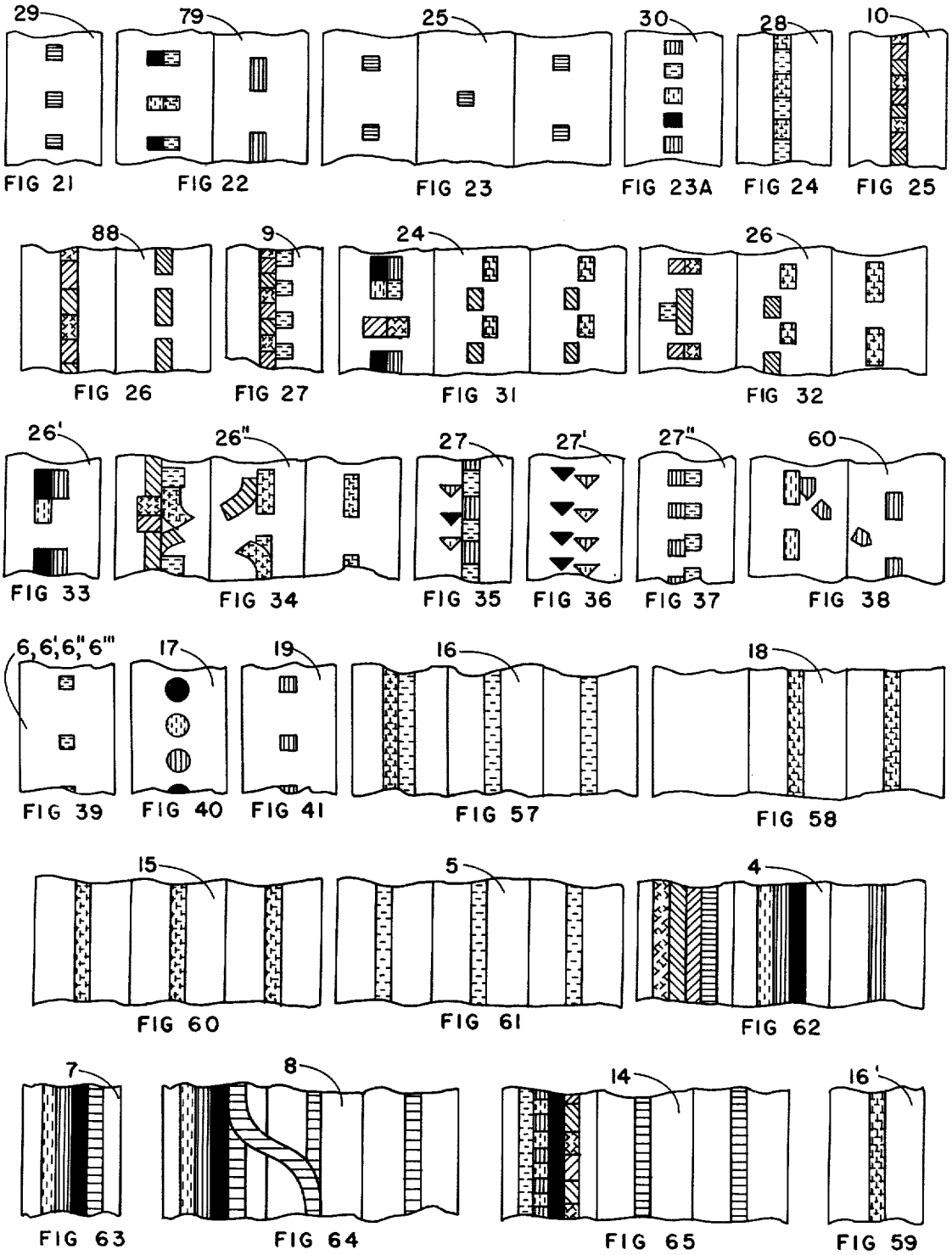
TRAFFIC FLOW
INVENTOR.
JAMES A. STICHA
BY
ATTORNEY

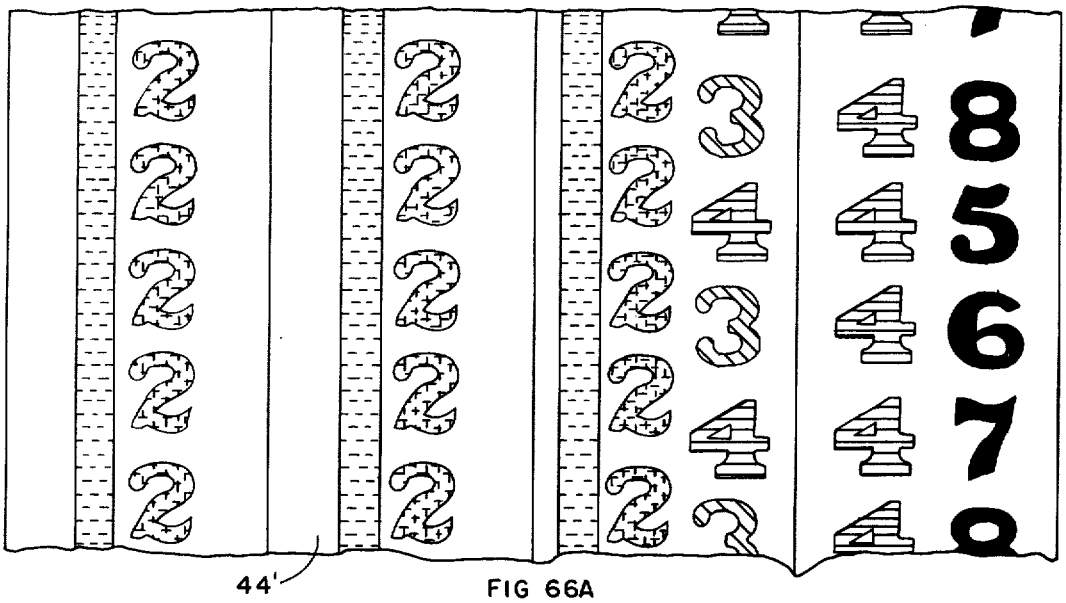
FIG 66A
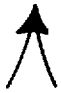
TRAFFIC FLOW
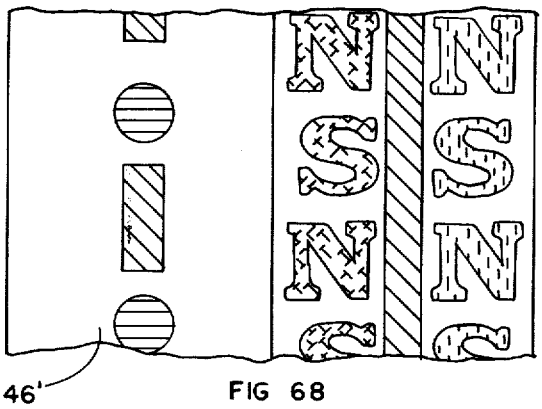
FIG 68
INVENTOR.
JAMES A. STICHA
BY
ATTORNEY

HIGHWAY COLOR CODE MARKING

Cross-References

This is a continuation of application Ser. No. 420,911, filed Dec. 3, 1973, now abandoned.

FIELD

This invention relates to color coded markers to assist in guiding motorists through complex traffic patterns and more particularly pertains to such markers disposed above or below the path to be followed by the vehicle occupied by the motorist.

PRIOR ART

No reference is known which discloses the invention. Each of the following patents discloses marking means which might be utilized in applying the invention to a roadway: U.S. Pat. Nos. Re. 16,035; Re. 16,131; 1,606,825; 1,638,744; 1,661,242; 1,664,070; 1,698,957; 1,703,227; 1,720,162; 1,733,161; 1,830,872; 2,007,524; 2,146,359; 3,011,412 and 3,215,051.

In particular it may be noted that U.S. Pat. No. 1,664,070 shows markers for the center line of one road and an intersecting road and shows an arrowhead at one end of the line. It does not, however, show the invention which will be described more fully hereinafter. Likewise, FIG. 2 of U.S. Pat. No. 3,215,051 might, on cursory inspection be assumed to show the invention. It, however, does not. It shows demarkation of the edges of the four lanes of a four-lane roadway and does not show indication of any path to be followed by a motorist in a complex intersection. The other patents show markers for the edges of lanes, markers to demarkate pedestrian crossing lanes and the like.

SUMMARY

Many modern highway interchanges require that a motorist entering the interchange who desires to emerge from the interchange headed toward a particular preselected destination follow a tortuous sinuous path through the interchange, repetitively selecting one of two or more choices of paths and rejecting possible exits in order that he emerge from the interchange headed toward his desired destination rather than headed in any one of several other possible directions.

Despite the best attempts of many highway departments to provide signs which give a motorist adequate information to make it possible for him to make the necessary selections in due time it has been well recognized in the literature pertaining to highway design that many motorists are vastly confused by problems posed to motorists in tracing such a sinuous tortuous path which is frought with alternate paths which lead him to undesired destinations. The rapidity with which the signs must be read, absorbed and decisions made based on the information thus obtained appears to be well beyond the ability of many motorists as indicated by documented experiences of highway design and supervision departments and of police departments who have to cope with the many accidents produced by such failures on the part of motorists.

One purpose of providing modern highway interchanges (which are characterized by vertical and horizontal separation of lanes for traffic heading in conflicting directions) is to provide a comparatively smooth, uninterrupted, continuous flow of traffic through the interchange, thereby avoiding the tie-ups and traffic delays which are produced at a normal intersection (such as one governed by traffic lights) when a high volume of traffic is introduced to the intersection. In order to fulfill this purpose of such interchanges, it is necessary that motorists not behave erratically in the interchange, such erratic behavior being characterized by traveling very slowly, slowing down suddenly, stopping or backing up or changing lanes suddenly to reach an exit from an unsuitable position or alternatively changing lanes suddenly to avoid following a line of traffic into an exit suddenly recognized by the motorist as leading to a destination undesirable to him. Sudden slowing, stopping, backing up and sudden violent lane changes are all well recognized as behavior which is likely to cause accidents and which if repeated very many times, is almost certain to cause an accident. Even moderate slowing down may be dangerous. Thus, a motorist who slows down in order to attempt to absorb all of the information contained on signs which he has not seen before, as in the case of a motorist traveling through an interchange for the first time, causes the traffic behind his vehicle to slow down. This may result in a considerable backup of cars and therefore result in much lane switching of vehicles behind him which are driven by people who are acquainted with the interchange, do not need to slow down and wish to maintain speed without interruption. Such lane changing of course is likely to cause an accident. Furthermore, if a motorist in an interchange is intent on reading signs rather than on traffic around him and at the last minute finds it necessary to change lanes he may do so without paying sufficient attention to traffic around him and may thereby cause an accident.

Even if such erratic behavior by a motorist does not cause an accident or is insufficiently erratic to be very likely to cause an accident, it is likely even in light traffic to cause a general interruption to the smooth flow of traffic through the interchange and in heavy traffic is almost certain to cause such an interruption.

Therefore, there is a need for means to make it possible for a motorist to readily follow a sinuous tortuous path through a complex highway interchange without taxing his mental capacity beyond its ability to absorb information and make decisions while traveling at a suitable rate of speed.

OBJECTS

It is therefore an object of this invention to provide a solution of the problems discussed above.

It is thus the principal object of the invention to provide means to guide a motorist easily and readily through a complex modern highway interchange.

It is a further object to provide means to simultaneously guide a plurality of motorists through such an interchange on each of the paths that might be selected by any motorist entering the interchange at any point and having any preselected destination to which any exit from the interchange may lead.

Other objects will become apparent from the drawings and from the following detailed description in which it is intended to illustrate the applicability of the invention without thereby limiting its scope to less than that of all equivalents which will be apparent to one skilled in the art.

DRAWINGS

In the drawings like reference numerals refer to like parts and:

FIGS. 5–68 are fragmentary, enlarged views of portions of the interchange of FIG. 1 showing application of the invention thereto.

DESCRIPTION

Figure 1:
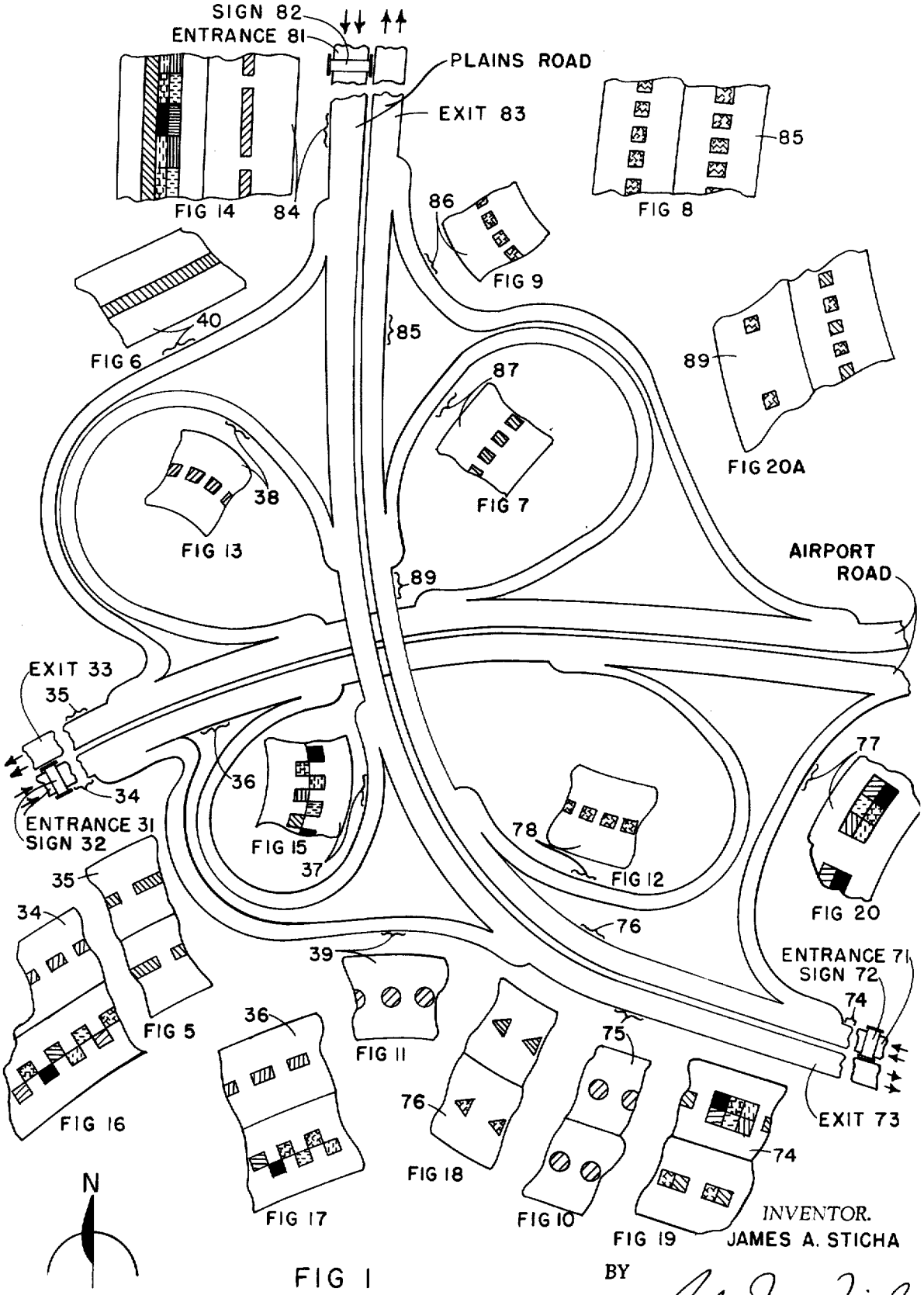
FIG. 1 is a plan view (in three parts) of an interchange having the invention applied thereto.
Figure 1:
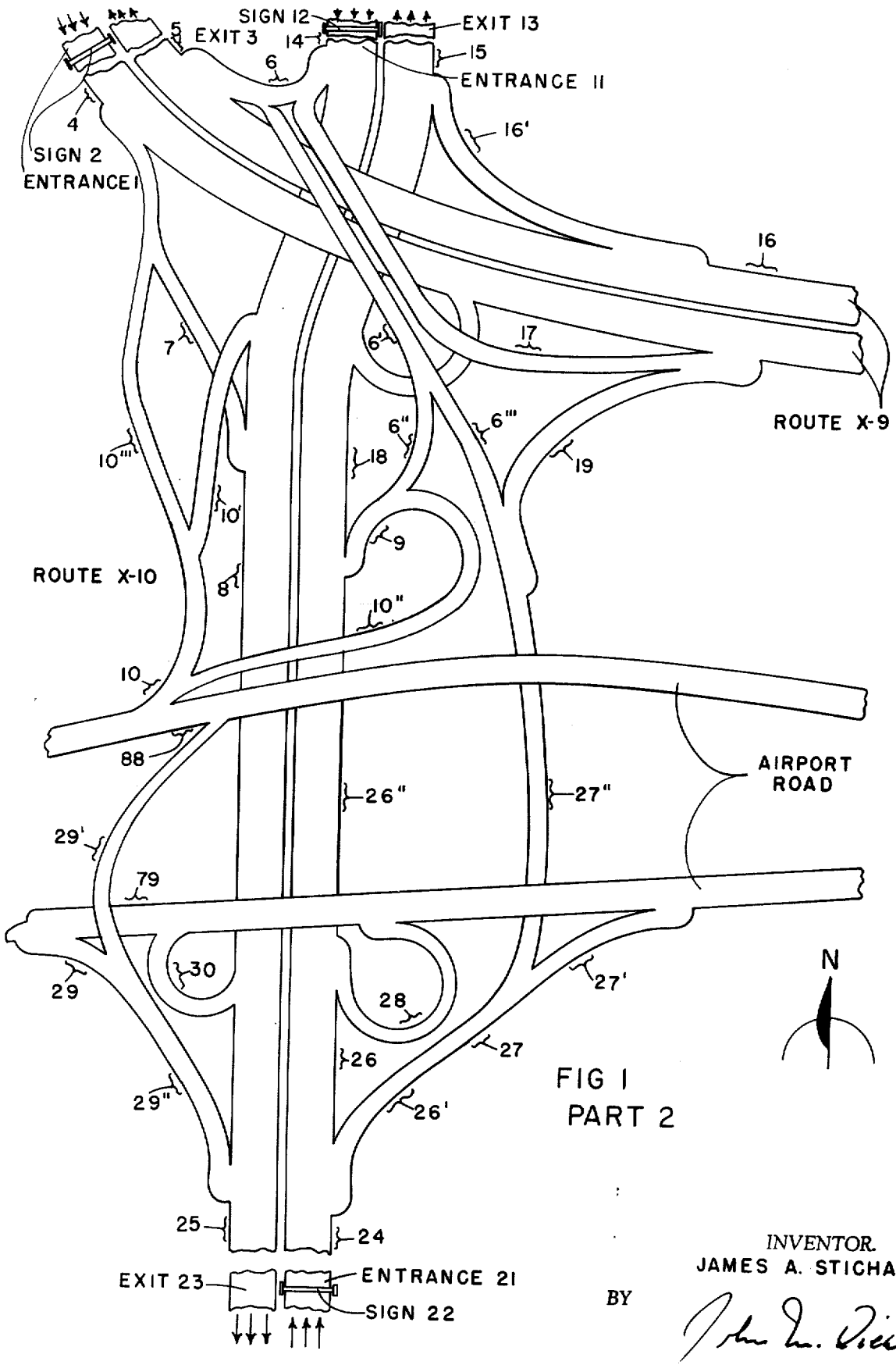
Figure 1:
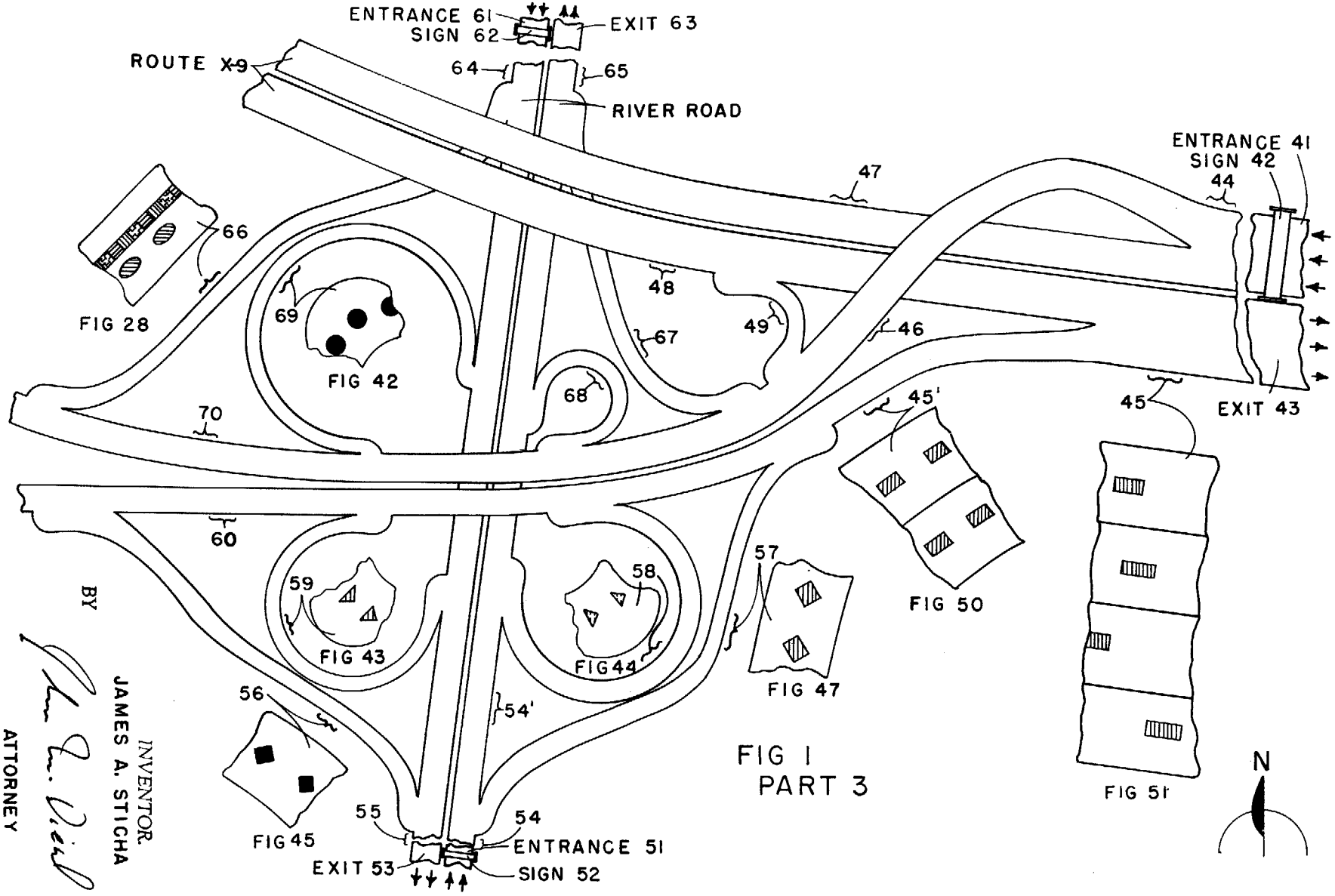

Referring now to FIG. 1 (which is in three parts) there is shown a modern, complex highway interchange. In one sense it may be considered a combination of three interchanges but since the decision of a motorist concerning the path to be followed to reach a desired destination must in most cases be made well ahead of time and must take into consideration factors introduced by all of the highway portions shown it is the most logical and best practice to consider the interchange as shown to be a single interchange.

Since within the interchange shown some of the connections are cloverleaf type connections and others are directional type connections it may be referred to as a combination cloverleaf-directional type interchange.

Nine vehicular entrances to the interchange are shown, namely entrances 1, 11, 21, 31, 41, 51, 61, 71 and 81. The interchange comprises nine vehicular exits which correspond to the entrances, these exits being exits 3, 13, 23, 33, 43, 53, 63, 73 and 83. In the instant interchange the exits are substantially parallel to and lie alongside the entrances but the invention is not restricted to entrances and exits thus arranged, nor is it restricted to interchanges wherein the exits and entrances are equal in number. All of the exits and entrances shown are multilane vehicular exits and entrances but the invention is not restricted to multi-lane vehicular entrances and exits but includes interchanges wherein one or more vehicular entrances or exits may be single lane. An entrance for the purpose of the invention may be considered as any point at which traffic on a highway approaches a group of highway portions which are so connected as to cause a vehicle operator to be faced with one or more decisions concerning alternative paths which he should take in order to best reach his destination. An exit may be considered as a point on a highway, following an entrance, beyond which a vehicle operator will not soon be faced with another such alternative. However, it is usually considered to be (and is illustrated here as) the point on a portion of highway leaving an interchange shortly after the last point at which vehicles from other parts of the interchange may enter the highway portion. Both meanings are encompassed within the scope of the invention.

The invention applies to vehicular highway interchanges such as that shown which comprise a plurality of intersecting highway portions and comprises at least three vehicular entrances and three vehicular exits.

It is to be noted that "exits" and "entrances" as used herein, that is, entrances and exits to an interchange, are to be distinguished from entrances and exits to connecting highway portions which provide the motorist with alternatives in choosing a route and which are provided by the multiplicity of exits and entrances to major highway portions within an interchange. Thus a loop in a cloverleaf normally comprises an exit from one major highway portion and an entrance to another major highway portion; such exits and entrances are not exits and entrances to the interchange.

Referring again to FIG. 1, the several exits may lead to destinations as shown below and the corresponding entrances may accordingly lead from such destinations into the interchange:

Exit 3 may lead to:
ROCK CITY, CAPITAL CITY AND POINTS WEST AND NORTH VIA ROUTE X-9;

Exit 13 may lead:
TO MILVALLEY AND POINTS NORTH AND WEST VIA ROUTE X-10;

Exit 23 may lead:
TO NEW YORK AND INTERMEDIATE POINTS EAST AND SOUTH VIA ROUTE X-10;

Exit 33 may lead:
TO AIRPORT, OROURKE FIELD;

Exit 43 may lead:
TO MAJOR CITY VIA PRESIDENT EXPRESSWAY;

Exit 53 may lead:
SOUTH TO BENJAMIN PARK;

Exit 63 may lead:
NORTH TO PLAIN CITY;

Exit 73 may lead:
SOUTH TO SHUMLEY PARK;

Exit 83 may lead:
NORTH TO PLAIN CITY.

The interchange may be considered to be an interchange involving five principal highways:

1. Plains Road, extending between Shumley Park and Plain City;
2. River Road, extending between Benjamin Park and Plain City;
3. Route X-10, extending from Milvalley and points north and west to New York and points east and south;
4. Airport Road, extending between an airport, Orourke Field, and Major City;
5. Route X-9, extending between Rock City, Capitol City and Major City.

The destinations and route numbers and names are not necessarily intended to correspond to actual locations or names but are chosen for convenience in describing the interchange to illustrate the invention.

It may be recognized that a different path must be taken from each entrance to reach any given exit and correspondingly from each entrance one or more characteristic paths extends to each exit.

Since there are nine exits a vehicle operator entering the interchange at any entrance may choose any one of eight paths to reach any one of the eight exits provided, excluding the exit which corresponds to and parallels the entrance at which he enters.

In accordance with the invention, distinctive markers are provided to mark each path so that a vehicle operator having chosen a destination may follow a distinctive set of markers in order to follow a path through the interchange which will lead to an exit most adapted to facilitate his reaching such destination.

For purposes of the invention it may be mentioned that an interchange to which the invention is applicable is one which has the characteristics mentioned above and which is provided with highway portions disposed to provide paths to be followed by vehicles within the interchange between entrances and exits wherein paths for vehicles traveling in conflicting directions are separated and wherein at least some of these paths are separated vertically. It will be noted that this condition applies in the interchange illustrated. Whereas not all paths are separated, all paths for vehicles traveling in conflicting directions are separated either horizontally, vertically or both and in an interchange to which the invention applies at least some of the paths for vehicles traveling in conflicting directions are separated vertically.

Referring again to FIG. 1 a sign may be provided on each highway portion which leads to an entrance. It may be located a considerable distance such as one, two or three miles before the entrance to provide a vehicle operator on such highway portion with the information needed to allow him to choose the markers he wishes to follow.

Thus, sign 2 which, as shown, is located above the highway leading to entrance 1, but which may suitably be located alongside said highway, may read:

FOLLOW COLORED MARKERS TOWARD DESTINATIONS AS FOLLOWS:

| | |
|---|---|
| RED | TO MAJOR CITY |
| YEL-LOW | TO MILVALLEY AND POINTS NORTH AND WEST VIA ROUTE X-10 |
| GREEN | TO AIRPORT, OROURKE FIELD |
| BLUE | TO NEW YORK AND POINTS EAST AND SOUTH VIA ROUTE X-10 |
| PURPLE | NORTH TO PLAIN CITY VIA RIVER ROAD |
| ORAN-GE | NORTH TO PLAIN CITY VIA PLAINS ROAD |
| BLACK | SOUTH TO BENJAMIN PARK VIA RIVER ROAD |
| BROWN | SOUTH TO SHUMLEY PARK VIA PLAINS ROAD |

or this information may be carried on a plurality of signs, for example two, three, four or more signs, all located a substantial distance ahead of entrance 1 above or alongside of the entering lanes.

Likewise sign 12 which may be located above the highway portion leading to entrance 11 may read:

FOLLOW COLORED MARKERS AS FOLLOWS:

| | |
|---|---|
| RED | TO MAJOR CITY |
| SILVER | TO ROCK CITY, CAPITOL CITY AND POINTS WEST AND NORTH VIA ROUTE X-9 |
| GREEN | TO AIRPORT, OROURKE FIELD |
| BLUE | TO NEW YORK AND POINTS EAST AND SOUTH VIA ROUTE X-10 |
| PURPLE | NORTH TO PLAIN CITY VIA RIVER ROAD |
| ORAN-GE | NORTH TO PLAIN CITY VIA PLAINS ROAD |
| BLACK | SOUTH TO BENJAMIN PARK VIA RIVER ROAD |
| BROWN | SOUTH TO SHUMLEY PARK VIA PLAINS ROAD |

Sign 22 located above the highway portion leading to entrance 21 may read:

FOLLOW COLORED MARKERS

| | |
|---|---|
| RED | TO MAJOR CITY |
| YEL-LOW | TO MILVALLEY AND POINTS NORTH AND WEST VIA ROUTE X-10 |
| GREEN | TO AIRPORT, OROURKE FIELD |
| SILVER | TO ROCK CITY, CAPITOL CITY, WEST AND NORTH VIA ROUTE X-9 |
| PURPLE | NORTH TO PLAIN CITY VIA RIVER ROAD |
| ORAN-GE | NORTH TO PLAIN CITY VIA PLAINS ROAD |
| BLACK | SOUTH TO BENJAMIN PARK VIA RIVER ROAD |

-continued

| | |
|---|---|
| BROWN | SOUTH TO SHUMLEY PARK VIA PLAINS ROAD |

Sign 32 located above the highway portion leading to entrance 31 may read:

FOLLOW COLORED MARKERS TOWARD FOLLOWING DESTINATIONS:

| | |
|---|---|
| RED | TO MAJOR CITY |
| YEL-LOW | TO MILVALLEY AND POINTS NORTH AND WEST VIA ROUTE X-10 |
| SILVER | TO ROCK CITY, CAPITOL CITY, WEST AND NORTH VIA ROUTE X-9 |
| BLUE | TO NEW YORK AND POINTS EAST AND SOUTH VIA ROUTE X-10 |
| PURPLE | NORTH TO PLAIN CITY VIA RIVER ROAD |
| ORAN-GE | NORTH TO PLAIN CITY VIA PLAINS ROAD |
| BLACK | SOUTH TO BENJAMIN PARK VIA RIVER ROAD |
| BROWN | SOUTH TO SHUMLEY PARK VIA PLAINS ROAD |

Sign 42 which may be located above the highway portion leading to entrance 41 as shown, may read:

FOLLOW COLORED MARKERS AS FOLLOWS:

| | |
|---|---|
| YEL-LOW | TO MILVALLEY AND POINTS NORTH AND WEST VIA ROUTE X-10 |
| BLUE | TO NEW YORK AND POINTS EAST AND SOUTH VIA ROUTE X-10 |
| GREEN | TO AIRPORT, OROURKE FIELD |
| SILVER | TO ROCK CITY, CAPITOL CITY, WEST AND NORTH VIA ROUTE X-9 |
| PURPLE | NORTH TO PLAIN CITY VIA RIVER ROAD |
| ORAN-GE | NORTH TO PLAIN CITY VIA PLAINS ROAD |
| BLACK | SOUTH TO BENJAMIN PARK VIA RIVER ROAD |
| BROWN | SOUTH TO SHUMLEY PARK VIA PLAINS ROAD |

Sign 52 which may be located above the highway portion leading to entrance 51, may read:

FOLLOW COLORED MARKERS FOR DESTINATIONS AS FOLLOWS:

| | |
|---|---|
| RED | TO MAJOR CITY |
| GREEN | TO AIRPORT, OROURKE FIELD |
| BLUE | TO NEW YORK AND POINTS EAST AND SOUTH VIA ROUTE X-10 |
| PURPLE | NORTH TO PLAIN CITY VIA RIVER ROAD |
| ORAN-GE | NORTH TO PLAIN CITY VIA PLAINS ROAD |
| BROWN | SOUTH TO SHUMLEY PARK VIA PLAINS ROAD |

Sign 62 which may be located above the highway portion leading to entrance 61, as shown, may read:

FOLLOW COLORED MARKERS FOR DESTINATIONS AS FOLLOWS:

| | |
|---|---|
| RED | TO MAJOR CITY |
| GREEN | TO AIRPORT, OROURKE FIELD |
| BLUE | TO NEW YORK AND POINTS EAST AND SOUTH VIA ROUTE X-10 |
| ORAN-GE | NORTH TO PLAIN CITY VIA PLAINS ROAD |
| BLACK | SOUTH TO BENJAMIN PARK VIA RIVER ROAD |
| BROWN | SOUTH TO SHUMLEY PARK VIA PLAINS ROAD |

Sign 72 which may be located as shown above the highway portion leading to entrance 71 may read:

FOLLOW COLORED MARKERS FOR DESTINATIONS AS FOLLOWS:

| | |
|---|---|
| RED | TO MAJOR CITY |
| GREEN | TO AIRPORT, OROURKE FIELD |

-continued

| | |
|---|---|
| SILVER | TO ROCK CITY AND CAPITOL CITY, WEST AND NORTH VIA ROUTE X-9 |
| YEL-LOW | TO MILVALLEY AND POINTS NORTH AND WEST VIA ROUTE X-10 |
| BLUE | TO NEW YORK AND POINTS EAST AND SOUTH VIA ROUTE X-10 |
| PURPLE | NORTH TO PLAIN CITY VIA RIVER ROAD |
| ORAN-GE | NORTH TO PLAIN CITY VIA PLAINS ROAD |
| BLACK | SOUTH TO BENJAMIN PARK VIA RIVER ROAD |

Sign 82 which may be located as shown above the highway portion leading to entrance 81 may read:

FOLLOW COLORED MARKERS FOR DESTINATIONS AS FOLLOWS:

| | |
|---|---|
| RED | TO MAJOR CITY |
| GREEN | TO AIRPORT, OROURKE FIELD |
| SILVER | TO ROCK CITY AND CAPITOL CITY, WEST AND NORTH VIA ROUTE X-9 |
| YEL-LOW | TO MILVALLEY AND POINTS NORTH AND WEST VIA ROUTE X-10 |
| BLUE | TO NEW YORK AND POINTS EAST AND SOUTH VIA ROUTE X-10 |
| PURPLE | NORTH TO PLAIN CITY VIA RIVER ROAD |
| BLACK | SOUTH TO BENJAMIN PARK VIA RIVER ROAD |
| BROWN | SOUTH TO SHUMLEY PARK VIA PLAINS ROAD |

The information embodied on each of the signs may instead of being embodied on one sign be embodied upon a plurality of signs. Thus, for each entrance, a portion of the information may be carried on a first sign, a portion on a second sign, a portion on a third sign and so forth, or there may be provided in addition to the signs described, each of which carries all of the information needed at each entrance, a plurality of subsidiary signs each repeating a portion of the information carried on the principal sign or there may be provided above or alongside the highway portion leading to an entrance two or three major signs each carrying on an appreciable portion of the information needed by the motorist prior to reaching the entrance, together with a plurality of subsidiary signs each repeating a minor portion of the information carried by one or another of the major signs. Any such sign may of course be located either partially alongside or partially above the highway portion from which it is to be observed.

The information on signs 2, 12, 22, 32, 42, 52, 62, 72 and 82 provides motorists entering the interchange from any of the nine entrances with the necessary information needed to follow appropriate markers which differ in color for each path marked.

It may be noted that all paths leading to a given exit may be distinguished by markers of the same color. Thus, all paths marked with markers which display the color grey to a vehicle traveling on said paths lead to exit 3. All paths marked with markers thus displaying the color yellow lead to exit 13; all paths marked with markers thus displaying the color purple lead to exit 63; all paths thus displaying the color red lead to exit 43; all paths marked by markers thus displaying the color black lead to exit 53; all markers thus displaying the color blue lead to exit 23; all paths marked with markers thus displaying the color brown lead to exit 73; all paths marked with markers thus displaying the color green, that is, displaying the color green to motorists traveling the paths marked with these markers, lead to exit 33; and all paths marked with markers thus displaying the color orange lead to exit 83. Thus To understand the invention more thoroughly it should be understood that the term "path" as used herein does not refer to a highway portion per se in the sense that the term is used to refer to a path in a woods or to a path across a field. The term path is used herein to refer to the path traveled by a vehicle in space or by the major portion of the vehicle. Thus a path as used herein has the width of a vehicle traveling it. The bottom of the path corresponds to the bottom of the vehicle and is thus a little above the surface of the highway. The top of the path is defined by the roof of the vehicle and thus is located an appreciably greater distance above the surface of the highway traveled by the vehicle. thus a marker set into the surface of the highway in the center of a line traveled by the vehicle is vertically disposed with respect to the path of the vehicle and more specifically is located below the path of the vehicle. Likewise a marker suspended above the center of a lane traveled by the vehicle is also disposed vertically with respect to the path of the vehicle and more particularly is disposed above the path of the vehicle.

Markers in accordance with the invention are disposed vertically with respect to the vehicle paths provided in the interchange and thus may be inset into the pavement below the paths of the vehicles or may be suspended above the paths of the vehicles.

Markers in accordance with the invention display a color to motorists approaching them and preferably display such color during both night and day.

Figures 2, 3:
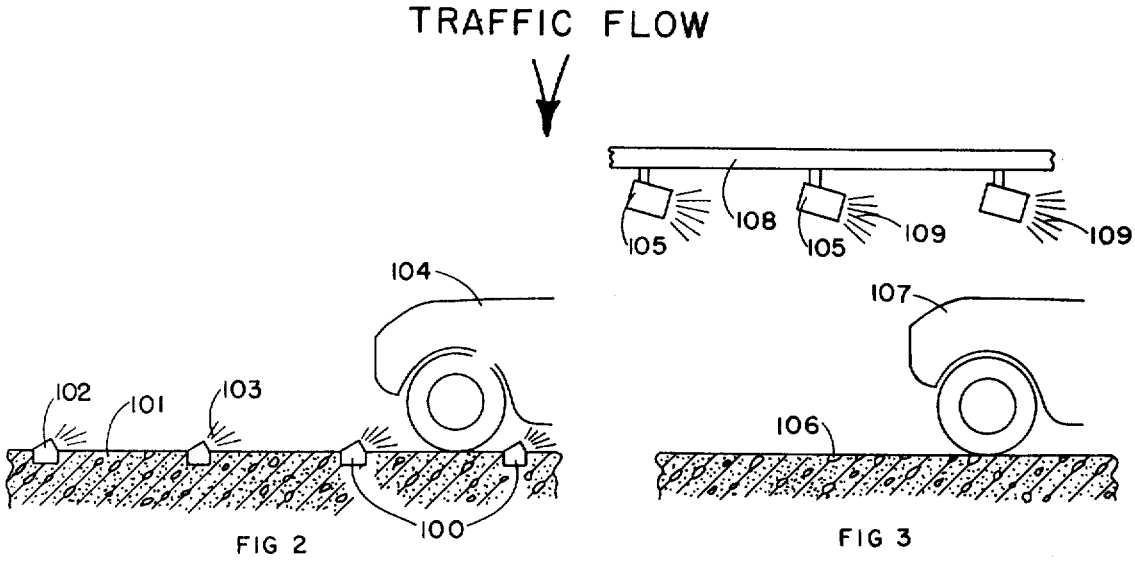
FIG. 2 is a schematic cross-sectional view of one embodiment.
FIG. 3 is a cross-sectional schematic view of another embodiment.

Thus as shown in FIG. 2 markers 100 may be inset into the surface of pavement 101 and may be provided with angled faces 102 adapted to reflect colored light, as indicated by rays 103, to the operator of an approaching vehicle 104. Such markers may be of plastic, metal, ceramic, glass or the like and may be made in accordance with such embodiments described in the patents listed above or modifications thereof as will provide the desired characteristics described hereinbefore and hereinafter.

In FIG. 3 there are shown markers 105 suspended above the surface of highway 106 and above the path traveled by vehicle 107. Markers 105 may be suspended from any suitable means such as from beam 108 which in turn is suspended above highway 106 by means not shown (for simplicity) and may be self-illuminated, that is, may contain lamps which emit light rays 109 in a direction observable by an operator of vehicle 107.

Figure 4:
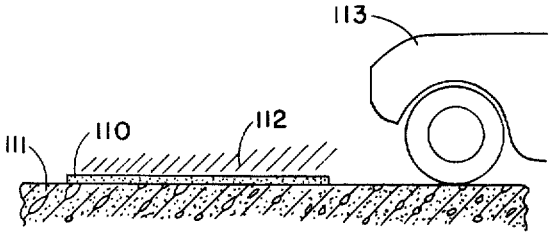
FIG. 4 is a cross-sectional schematic view of another embodiment.

As shown in FIG. 4 a marker may be a layer of paint 110 on a highway surface 111 disposed to reflect colored light rays, as indicated by rays 112, to the eyes of the operator of motor vehicle 113.

Thus the invention is not restricted to any particular type or material of marker, it being only necessary to the invention that the markers marking the path be disposed vertically with respect to the path, that is, either above or below it, and that they cause light rays of a preselected color to shine toward the eyes of the operator of a motor vehicle approaching the markers, either by reflection of sunlight or by reflection of light from the vehicle's head lamps or from lamps provided therewithin or in any other suitable way. As may be seen from a consideration of FIG. 4 it is not necessary that the faces of the markers be slanted toward vehicles approaching them, as they are in FIGS. 2 and 3, as long as the markers provide light of a desired color shining toward the oncoming vehicles.

In accordance with the invention the markers are disposed vertically with respect to the vehicle paths rather than alongside the paths for several reasons. A driver may readily, with an absolute minimum of angular movement of his eyes from the road directly ahead of him observe markers, either above or below his path. To shift his eyes to one side or the other in order to keep track of markers which he wishes to follow involves, or is likely to involve, greater head and eye movement, thus increasing the time during which his eyes depart from observing the road, vehicles he is following and vehicles around him and thus increasing the opportunity for accident and thereby the likelihood of accident.

Furthermore, in a complex intersection in which each path often involves a number of turns in both directions and may involve a number of junctures with and departures from other paths the difficulty of following a path is greatly increased if the markers are placed alongside. This is particularly true when a path crosses a highway, that is, when it is necessary for a driver to switch from a right hand lane to a left hand lane or vice versa in order to follow a path. Markers alongside are unsatisfactory and substantially inoperable and entirely unsuitable in accordance with the invention.

FIGS. 5 to 68 illustrate various patterns in which markers may be provided and shapes which individual markers may display to motorists approaching them.

As shown in FIG. 5 highway portion 35 comprises two lanes which marked with green markers. These may be long and rectangular as shown.

As shown in FIG. 6 the single lane connector at 40 may be marked with a green stripe in the middle.

As shown in FIG. 7 the single lane connector of which 87 is a portion may be marked with a single row of green markers having square shapes.

Just prior to exit 83, portion 85 of the two-lane highway leading to the exit may be marked as shown in FIG. 8 with a row of square orange markers in each lane and as shown in FIG. 9 portion 86 of a one lane connector may be marked with rectangular orange markers.

Each lane of the two-lane highway approaching exit 73 may be marked with a single row of round brown markers as shown in FIG. 10 and portion 39 of the connector shown in FIG. 11 may be similarly marked. Connector portions 78 and 38 shown in FIGS. 12 and 13 may be marked respectively with a single row of rectangular orange and brown markers in the center of the lane.

At entrance 81 all traffic other than that destined for exit 73 should be in the right lane in order to exit into the connectors of which 40 and 37 are portions respectively and therefore the left lane may most suitably be marked with a single row of brown markers in the center while the right lanes may most suitably be marked as shown with markers bearing the seven other colors corresponding to the seven other exits from the interchange. Since traffic which is to exit into the connector of which 40 is a part must exit first, it may be most suitable to provide such marking as a stripe on the right hand side. Thus a green marker stripe is provided as shown. The six other markers of other colors may be rectangular and may be provided as shown in two rows as shown in FIG. 14. Traffic in this lane which does not turn into the first exit should turn at the second exit into the connector of which portion 37 is a part. Through traffic may follow the path marked with long rectangular brown markers to exit 73. If desired a different pattern for the markers may be used as shown in FIG. 15.

Highway portion 34 prior to entrance 31 may be marked as shown in FIG. 16 with a single row of rectangular red markers in the left lane. A plurality of rectangular markers in staggered arrangement in two rows having the seven other colors corresponding to the seven other exits may be provided in the right lane. Since the path marked with brown markers turns right into the connector of which portion 39 is a part portion 36 as shown in FIG. 17 may be marked in much the same manner as FIG. 16 with the exception that brown markers do not appear in the right lane. Also the shape of the rectangles used and their arrangement may be different as shown.

In FIGS. 5–17 it is not intended to indicate that it is desirable that the shape and spacing of the markers be as different as is shown for the various portions shown. Thus the arrangements shown for the right lane in FIG. 14, 16 and 17 and for the single lane in FIG. 15 are alternate arrangements, any one of which might be used throughout the interchange.

Suitable markers may provide substantially pyramid-like portions extending above the surface of the pavement each of which has a slanting colored face presented toward oncoming traffic as shown for the green and orange markers in the two lanes of portion 76 shown in FIG. 18.

Since the paths for all traffic entering at entrance 71 lead into the connector of which 77 is a part, except for paths marked with orange and green, it is particularly suitable to provide at portion 74, as shown in FIG. 19, orange and green markers in the left lane and markers of both green and the other colors in the right lane, as shown, to readily distinguish the six paths indicated by the colors blue, black, grey, yellow, red and purple from the path indicated by green markers in the right lane, when the six aforementioned paths turn into the connector of which 77 is a part. It may be particularly suitable to provide the markers in the pattern shown. This same pattern may be advantageously followed in the connector of which portion 77 is a part, as shown in FIG. 20, to provide continuity. Since at portions 74 and 76, the path marked with orange markers leads to exit 83, this path for through traffic may more suitably be routed in the left lane as shown. By the time traffic reaches the portion 76, all traffic which is to exit right at the next available connector in order to reach interchange exit 33 should be in the right lane and therefore green markers no longer appear in the left lane. At portion 89, as shown in FIG. 20A, orange markers appear in the right lane because traffic following the orange path has just entered the main highway section from the connector of which 78 is a portion.

Since all traffic in one lane connectors at portions 29, 29' and 29'' is headed toward exit 23, these portions may be marked with a single row of blue markers as shown in FIG. 21.

Since no blue-marked paths appear at portion 79 and all through traffic headed for Major City should be in the left lane at this point, portion 79 may suitably be marked as shown in FIG. 22. The three lanes at portion 25 may be marked as shown in FIG. 23.

It may be more suitable to provide a comparatively wide spacing between markers on connectors which carry only a single path (for example, at portions 29, 29′, 29″, 78, 39, 38, 87, 40, 86 and the like) since traffic at these portions has no alternative but to continue to follow the single lane provided and motorists at these portions have no further opportunity to make turns which would lead them to an undesired exit. Likewise the spacing of markers may suitably be greater in portions near exits such as portions 33, 75, 85, 25 and the like since vehicle operators in these portions are already inexorably headed for an exit and no longer have an opportunity to make any turn which would lead them to another exit.

Markers might indeed be omitted in such portions. But to provide a psychological "security blanket" to un-sure drivers to prevent 23A from slowing down when markers are no longer visible and yet the exit has not yet been reached, thereby to provide a desirable smooth flow of steadily moving traffic, and 10‴ are is believed best to provide suitable markers in all lanes until the interchange exit is reached.

Markers of different colors may be provided in a single row of successive squares as shown for portions 30 in FIG. 2A or in a single row of adjoining squares or rectangles as shown for portions 23, 10 and 88 in FIGS. 24, 25 and 26. (Portions 10, 10′,10″ are shown in FIG. 25.)

Figures 29, 30, 46, 48, 49:
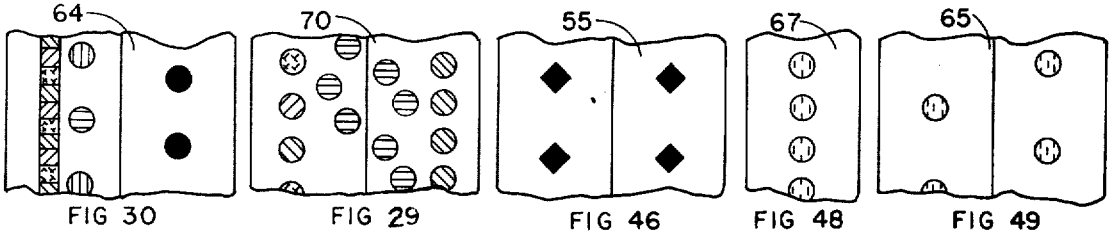

In a single lane connector the paths of traffic which will continue in the same line after debauching from the connector may be indicated with square or rectangular markers adjoining, in a single row, as shown in FIGS. 27, 28 and 29 for portions 9, 66 and 63 respectively, whereas markers for a path which is soon to diverge from the other paths may be provided in an adjacent row of spaced apart markers which may be square as shown in FIG. 27 for a grey path or may be round or oval as shown respectively in FIGS. 29 and 28 for blue paths. Similar marking may be used in the right lane of a two-lane portion as shown for portion 64 at entrance 61 in FIG. 30.

It may be here repeated that it is not suggested that the shape of the markers for a blue path follow a transition as indicated in FIGS. 30 and 28, from round to oval. Rather these figures as well as many others are presented to illustrate that the markers may have a wide variety of shapes and may be disposed in any one of a great many patterns.

It is desirable and preferred that the same pattern and shapes be continued throughout the interchange, as discussed more fully hereinafter.

A relatively consistent pattern of marking is shown for portions 24, 26, 26′ and 26″ FIGS. 31, 32, 33 and 34.

Instead of markers of the pattern and shape shown for path 26′ in FIG. 33 the markers for the connector of which it is a part may have the pattern and shape shown for portion 27 in FIG. 35 and by natural transition may have the shapes and patterns at portions 27′ and 27″ which are shown in FIGS. 36 and 37, respectively. Note that in FIG. 35 the provision of the markers for one path as a single row of rectangles on the left and the markers for three paths as a row of triangles on the right tends to suggest that these two rows might split, as the paths in fact shortly do. Likewise, as shown in FIG. 36, the arrangement of the triangular markers in a left row of two colors to mark two paths and a right hand row of one color to mark one path may suggest that the path indicated by the markers in the right hand row will bear right as in fact it does only a very little later. Another method of indicating a forthcoming divergence of paths by change of pattern is shown in FIG. 37 wherein the spacing of markers in one path is gradually changed to indicate an impending turn of this path. As shown in FIG. 38 the only paths which remain on portion 60 are those marked with red and purple markers, the path marked with black markers having turned off to the right. Because another lane of traffic will shortly enter from the right and the lane marked with red is part of a path for through traffic headed toward Major City, it may be desirable to indicate that traffic in the right lane following a red marked path should move into the left lane. If desired, markers to indicate such a lane change may be more closely spaced than markers indicating mere continuance of a path in the same lane. And likewise markers indicating such lane change may suitably have a different shape, for example, being somewhat pointed in front as shown in FIG. 38.

Similarly as shown for portion 70 in FIG. 39, markers indicating lane change may be more closely spaced than markers indicating continuance of a path in the same lane; as indicated in FIG. 39, such spacing may be as well carried out with round shaped workers as with square, rectangular or triangular shaped markers.

Portions 6, 6′, 6″ and 6‴ are shown in FIG. 39A. Portions 17, 19, 69, 59, 58, 56, 55, 57, 67, 65, 45′ and 45 are shown respectively in FIGS. 40, 41, 42, 43, 44, 45, 46, 47, 48, 49, 50 and 51. FIGS. 39A–51 show various spacings and marker shapes; some are different from, some simialr to and some identical with some previously illustrated.

Figures 53, 54, 55, 56:
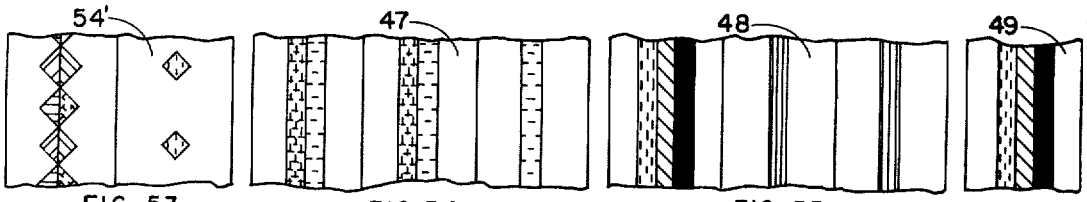
Figures 52, 66, 67:
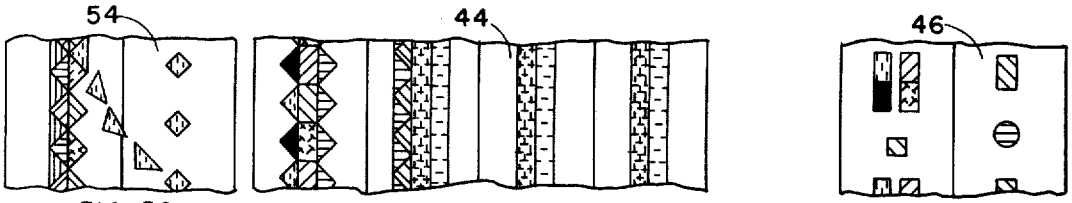

Portion 54 may be marked as shown in FIG. 52. By marking the right lane with triangular shaped markers arranged in the pattern shown, compact and easily recognizable marking is provided for the six paths to be located in the right lane while the left lane carries a single path of through traffic. A change of lanes for the purple path from the right lane to the left lane is particularly readily discernible since the triangular purple markers tend to appear to separate from the remaining triangular markers in the right lane in the manner in which a "zipper" separates and the distinction of the marking in the right lane prior to, during and following the lane change of the purple path is readily discernible. After the markers indicating the red path have similarly diverged into the connector of which portion 57 is a part, the lanes are marked as shown for portion 54′ in FIG. 53. It may be observed that the marking in FIG. 53 is identical with that in FIG. 52 with the exception of the removal from the right lane of markers for the purple and red paths. The type of consistency represented by the difference between FIGS. 52 and 53 is desirable throughout the entire interchange.

Portions 47, 48, 49, 16, 18, 16′, 15, 5, 4, 7 and 8 are shown respectively in FIGS. 54, 55, 56, 57, 58, 59, 60, 61, 62, 63 and 64. These figures, that is FIGS. 54–64, show a consistent pattern of marking wherein the markers appear as stripes or strips. Thus a red marked path is marked with a single strip-like marker such as a stripe of paint or with a plurality of individual rectangular or square markers presenting a continuous strip-like appearance to the eye. Where each lane carries from one to four paths, as shown, this is believed to be a most effective and successful pattern of marking. It is relatively easy for an operator to follow a continuous strip. However, where more than four paths are located in a single lane as is the case for portions 14 and 44 shown in FIGS. 65 and 66 a plurality of strips may become difficult to follow. Possible solutions are indicated by providing combinations of disparate markers with strips as shown for portions 14 and 44 in FIGS. 65 and 66. Thus at entrance 12 the center and left lanes which carry through traffic on blue marked paths may be marked with strip markers. The seven paths located in the right lane may be marked respectively from the right with a grey strip for a grey path which turns off to the right twice in immediate succession, then a row of purple and red markers and a row marked as a strip of black for three paths which turn off to the right with the grey path at its first turn but then bear left when it bears right, and finally a single row containing markers of three colors, orange green and brown, for three paths which continue in the same lane until the succeeding connector exit. As shown in FIG. 66, markers in the form of stripes may be utilized in the same roadway as markers having both rectangular and triangular shapes and thus some of the benefits of strip shaped markers may be combined with some of the benefits of triangular markers in the contiguous pattern discussed in connection with FIGS. 52 and 53. For example, the second lane from the right of portion 44 at entrance 41 carries four paths marked respectively blue, green, yellow and grey. Shortly after the entrance these paths split, the green and blue paths bearing right, the yellow and grey paths bearing left. Obviously if the grey and yellow strips are caused to bear left as a pair and the green and blue triangles are continued as a single row bearing right the divergence will be comparatively apparent to a vehicle operator. Similar striking change in pattern will be observed by an operator when the two paths marked with purple and black triangles on the right diverge from the center strip of contiguous orange, green and brown markers. Also the separation of the path indicated by the blue triangles on the left of the center strip of contiguous rectangular orange, green and brown markers will be readily apparent.

In complex interchanges such as that illustrated a situation is encountered which is not encountered in simpler intersections. Namely, a vehicle may be able to reach a given exit from a given entrance via two or even three or more different paths. Thus vehicles entering at entrance 1 destined for exit 43 may travel on Route X-9 without utilizing any connector. However, they also may utilize the connector of which portion 7 is a part headed and then the connector of which loop 30 is a part thence reaching exit 43 on the east bound portion of Airport Road.

Traffic headed for the airport from entrance 1 would normally be expected to take the connector of which portion 10''' is a part but if a vehicle misses the turn onto this connector it may turn onto the connector of which portion 49 is a part and thence travel to the airport on the west bound portion of Airport Road. Likewise, vehicles from entrance 1 headed for either exit 53 or exit 63 may travel down the connector of which portion 7 is a part and take the loop of which portion 30 is a part, thence traveling east on the east bound portion of Airport Road and turning onto the connectors of which portions 56 and 58 respectively are a part to reach exits 53 and 63. But, alternatively, vehicles destined for these exits may travel on Route X-9 from entrance 1 to the connector of which 49 is a part. From the point at which this connector debauches onto the west bound portion of Airport Road, traffic heated for exit 63 may immediately bear right on the connector of which portion 67 is a part while traffic destined for exit 53 may turn right on the connector loop of which portion 69 is a part. Vehicles entering at entrance 21 headed for Major City must bear right on the connector of which portion 27 is a part but may then bear right on the connector of which portion 27' is a part to thence travel eastwardly to exit 43 on the east bound portion of Airport Road or may alternatively bear left on the connector of which 27'' is a part and then right on the connector of which portion 19 is a part to travel to exit 43 on the east bound portion of Route X-9. Traffic headed for exit 3 from entrance 21 may bear right onto the connector of which portion 27 is a part and then left on the connector of which portions 27'' and 6''' are parts to finally reach the connector of which 6' is a part and thereby reach exit 3 or may alternatively travel up Route X-10 until bearing right on the connector of which portion 9 is a part and thence bearing left on the connector of which portion 6'' is a part to then join the other path coming up from the south.

Whereas the normal orange, green and brown paths extend south on the connector which 10''' is a part, alternates of these paths also extend down Route X-9 to the connector of which portion 49 is a part.

Any one of three policies for marking such alternates may be used. First, both alternates may be marked. Thus, this has been done throughout in the present instance except that brown and orange paths are not indicated along the east bound portion of Route X-9 to portion 48 and thence on the connector of which portion 49 is a part. Secondly, only one of the two alternate paths may be marked. In the present instance, this has been done only for the orange and brown paths leading from entrance 1 to the point at which the connector of which portion 10 is a part debaunches into the west bound portion of Airport Road. In other words, alternate routing for these two paths down Route X-9 to portion 48 and thence onto the connector of which portion 49 is a part is not shown. It may be mentioned in connection with the first policy that equal marking of the divergence, such as disclosed for the red path in traveling from the single lane connector at 27 respectively right and left to single lane connectors at 27' and 27'' may cause indecision on the part of an operator which may result in causing him to slow or even stop his vehicle. This is obviously likely to tend to increase the likelihood of accidents by reason of interruption of smooth traffic flow. A third policy is to mark a preferred path entirely from the entrance to the exit and then to start marking the alternate path following the turnoff of the preferred path so that vehicles which may have inadvertently missed the turnoff for the preferred path may follow the alternate path. If this latter policy is utilized, it may be most suitably effectuated by providing subsidiary signs alongside or above the lane in which the alternate path is marked, reminding motorists that though they may have missed a turn by failing to adequately follow the markers, they can still correct their mistake.

FIGS. 67 and 68 respectively show portion 46 and a modification of portion 46 indicated as portion 46'. These figures indicate preferred embodiments. The marking of the right lane in FIG. 46 is similar in pattern, design and purpose to the marking of portion 74 shown in FIG. 19 and discussed in connection with portions 89 and 77 shown in FIGS. 20 and 20A. The marking of the left lane is a possible preferred form not shown in other figures wherein two shapes of markers appear in a single row. It may be most desirable to provide, for example, all green markers as squares, all blue markers as circles, all red markers as triangles, all yellow markers as rectangles, and the like; that is, each colored marker may well also have a distinctive shape. However, as shown in FIG. 68 it is not necessary to the invention that all markers for paths leading to one exit be different in color from all markers for paths leading to another exit. Thus the paths shown throughout the previously described figures as marked respectively with purple and black markers may be marked respectively with markers having the shape of the letter N colored purple and markers having the shape of an S colored purple so that all paths leading to River Road would be colored purple and paths leading to River Road exit 63 would be distinguished by being or having the shape of the letter N whereas paths leading to River Road exit 53 would be marked with markers having the shape of the letter S. Likewise, paths leading to Plains Road may be marked with N and S markers colored orange instead of with orange and brown markers respectively. Of course, any two shapes may be substituted for the letters N and S. Thus, squares may be used instead of the letter N and circular markers in place of the letter S. These may be utilized in connection with stripe-type markers as shown for the right lane green marker in FIG. 68. In the left lane of portion 46' shown in FIG. 68 is shown the use of circular markers colored blue which might be extended for all blue markers throughout the interchange and long rectangular markers colored green which might be extended for all green markers throughout the interchange.

As a further modification, the shape of all or some of the markers may be made that of numerals. In this case paths may be identified in part by color and in part by the shape of the markers, but identification and ease of following a given path may be eased by reason of markers being familiar numeric shapes rather than such geometric shapes as squares, triangles and the like. Accordingly FIG. 66A shows modification 44' of portion 44. Paths leading to exit 3 may be marked as in FIG. 66, with silver stripe markers. Paths leading to exit 13 may be marked with yellow markers having the shape of the numeral 2. Paths leading respectively to exits 23 and 33 may be marked with green markers each having the shape of 3 and blue markers each having the shape of 4. Paths leading to exits 53, 63, 73 and 83 may be marked with markers all having the same color (for example, black, as shown) and may have the shapes respectively of numerals 5, 6, 7 and 8. Thus, differentiation between markers to distinguish paths to various exits may be based on both shape and color, as for paths to exits 3, 13, 23 and 33, and the group consisting of exits 53, 63, 73 and 83 or may be used on shape alone, as for paths to exits 53, 63, 73 and 83.

By use of shape and color in conjunction instead of by color coding alone, the number of colors required for an interchange may be reduced and thereby the use of colors which are not readily distinguishable such as for example purple and black, orange and brown, and the use of a color which is not readily distinguishable as a separate color (such as the color silver or grey) may be avoided or minimized.

Although it has been made clear that an appreciable variation in applying the invention falls within the scope of the invention it is nonetheless essential to the invention that all markers used to mark a single path be of like shape and color, that is, consistent in appearance. If, say, red triangles are chosen to mark one path or even all paths leading to a given exit, the spacing of these from one another may be different at different parts of the interchange and the size of the markers may be different at different parts of the interchange. Larger markers may be used where it is desired to particularly attract the attention of a motorist following a line of markers in order to make sure that he follows them through a certain turn or to indicate some special feature of the path, such as an impending turnoff. The shape of the markers may be altered for the same purpose. For example, triangles may be altered from equilateral to isosceles, circles may be altered to ovals, and squares altered to rectangles, where desired for accentuation. If may however be reiterated that though the size and pattern of markers marking a path may vary, it is essential to the invention that the shape and color be at least substantially consistent for all markers marking any given path.

It will be apparent to those skilled in the art that numerous modifications of the apparatus described may be made without departing from the intended scope of the description. For the purpose of accomplishing the above described objects the claims are intended to include such modifications as may be made within the limits defined by the claims.

Having thus described my invention, I claim:

1. In a multilevel highway interchange having a plurality of paths, exits and entrances, a multicolored stripe associated with each major path in the interchange, the colors of said stripe being provided by marking means, each of said colors corresponding to only one of said exits and each of said exits having a different color corresponding therewith, said multicolored stripe having a colored stripe leading away therefrom in association with each path departing from said major path with which it is associated, said colored stripe leading away from said major path being a multicolored stripe for each such path which may be followed toward more than a single exit, said multicolored stripe having a colored stripe joining it in association with each path which joins said major path, each entrance provided with sign means indicating the association of colors and exits.

2. In the interchange of claim 1, the embodiment wherein said multicolored stripes are provided by a plurality of essentially continuous longitudinally extended strips of colored material.

3. In the interchange of claim 1, the embodiment wherein said multicolored stripes are provided by a plurality of contiguous rectilinear sheets of colored material.

4. In the interchange of claim 1, the embodiment wherein said multicolored strips are provided by a plurality of spaced apart marking members.

5. In the interchange of claim 4, wherein said members are circular.

6. In the interchange of claim 4, wherein said members have the form of numerals, a preselected digit being associated with each color.

* * * * *